US010754279B2

(12) United States Patent
Kokubo

(10) Patent No.: US 10,754,279 B2
(45) Date of Patent: Aug. 25, 2020

(54) IMAGE FORMING APPARATUS HAVING AIR BLOWING ON A SHEET

(71) Applicant: CANON KABUSHIKI KAISHA, Tokyo (JP)

(72) Inventor: Hiroshi Kokubo, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/537,772

(22) Filed: Aug. 12, 2019

(65) Prior Publication Data

US 2020/0073298 A1 Mar. 5, 2020

(30) Foreign Application Priority Data

Aug. 31, 2018 (JP) ..... 2018-163333
Jul. 11, 2019 (JP) ..... 2019-129410

(51) Int. Cl.

| | |
|---|---|
| ***G03G 21/20*** | (2006.01) |
| ***G03G 15/20*** | (2006.01) |
| ***G03G 15/08*** | (2006.01) |
| ***G03G 15/00*** | (2006.01) |

(52) U.S. Cl.

CPC ..... *G03G 15/2032* (2013.01); *G03G 15/0887* (2013.01); *G03G 15/6579* (2013.01); *G03G 21/206* (2013.01); *G03G 15/2021* (2013.01); *G03G 2215/0043* (2013.01); *G03G 2215/00438* (2013.01); *G03G 2221/1645* (2013.01)

(58) Field of Classification Search

CPC ..... G03G 15/2032; G03G 15/0887; G03G 15/6579; G03G 2215/0043; G03G 2215/00438; G03G 15/2021; G03G 21/206; G03G 2221/1645

See application file for complete search history.

(56) References Cited

U.S. PATENT DOCUMENTS 4,959,693 A * 9/1990 Mitsuya ..... G03G 15/2064 219/216
8,103,205 B2 * 1/2012 David ..... G03G 15/20 399/322

(Continued)

FOREIGN PATENT DOCUMENTS

JP 2015-025911 A 2/2015

*Primary Examiner* — Walter L Lindsay, Jr.
*Assistant Examiner* — Laura Roth
(74) *Attorney, Agent, or Firm* — Venable LLP

(57) ABSTRACT

An image forming apparatus includes a transfer portion to transfer a toner image to a sheet, a fixing portion to fix the toner image, a reverse conveyance portion to perform a reverse conveyance operation in which the sheet is conveyed to a first direction and thereafter conveyed to a second direction that is opposite to the first direction, and a reverse guide configured to guide the sheet in the reverse conveyance operation. A conveyance guide pair forms a conveyance path through which the sheet subjected to the reverse conveyance operation passes, and guides the sheet toward the transfer portion, and an air blowing portion blows air toward the conveyance path. In addition, a ventilation portion is provided through which air blowing from the air blowing portion toward the reverse guide passes, the air having passed through the ventilation portion flowing along the reverse guide.

16 Claims, 10 Drawing Sheets

(56) References Cited

U.S. PATENT DOCUMENTS

| | | | | |
|---|---|---|---|---|
| 2009/0060616 | A1* | 3/2009 | Koyanagi | G03G 15/234 399/401 |
| 2012/0201564 | A1* | 8/2012 | Masuda | B65H 5/26 399/92 |
| 2018/0305152 | A1* | 10/2018 | Sakurai | B65H 85/00 |
| 2018/0305153 | A1 | 10/2018 | Kokubo | |

* cited by examiner

IMAGE FORMING APPARATUS HAVING AIR BLOWING ON A SHEET

BACKGROUND OF THE INVENTION

Field of the Invention

The present invention relates to an image forming apparatus configured to form a toner image on a sheet.

Description of the Related Art

Hitherto, an image forming apparatus is known in which a toner image is transferred to a sheet at an image transfer portion and the toner image is fixed to the sheet in a fixing device (refer to Japanese Patent Application Laid-Open Publication No. 2015-25911). According to the image forming apparatus, if an image is to be formed on both sides of the sheet, the sheet on which a toner image is formed on a first side is guided to an evacuation conveyance path, and the sheet is subjected to switchback conveyance in the evacuation conveyance path. Thereafter, the sheet is guided again to the image transfer portion, and at the image transfer portion, a toner image is formed on a second side.

However, according to the image forming apparatus disclosed in Japanese Patent Application Laid-Open Publication No. 2015-25911, the side on which toner image has been formed of the sheet conveyed through the evacuation conveyance path is rubbed against the evacuation conveyance path. In this state, the sheet may stick on the evacuation conveyance path and the sheet may be buckled, which may lead to occurrence of conveyance failure such as sheet jamming.

SUMMARY OF THE INVENTION

According to one aspect of the present invention, an image forming apparatus includes a transfer portion configured to transfer a toner image to a sheet, a fixing portion configured to fix the toner image transferred by the transfer portion to the sheet, a reverse conveyance portion configured to perform a reverse conveyance operation in which the sheet onto which the toner image has been fixed is conveyed to a first direction and thereafter conveyed to a second direction that is opposite to the first direction, a reverse guide configured to guide the sheet in reverse conveyance operation, a conveyance guide pair configured to form a conveyance path through which the sheet subjected to the reverse conveyance operation passes, and to guide the sheet toward the transfer portion, an air blowing portion configured to blow air toward the conveyance path, and a ventilation portion through which air blowing from the air blowing portion toward the reverse guide passes, the air having passed through the ventilation portion flowing along the reverse guide.

Further features of the present invention will become apparent from the following description of exemplary embodiments with reference to the attached drawings.

DESCRIPTION OF THE EMBODIMENTS

First Embodiment

General Configuration

Figure 1:
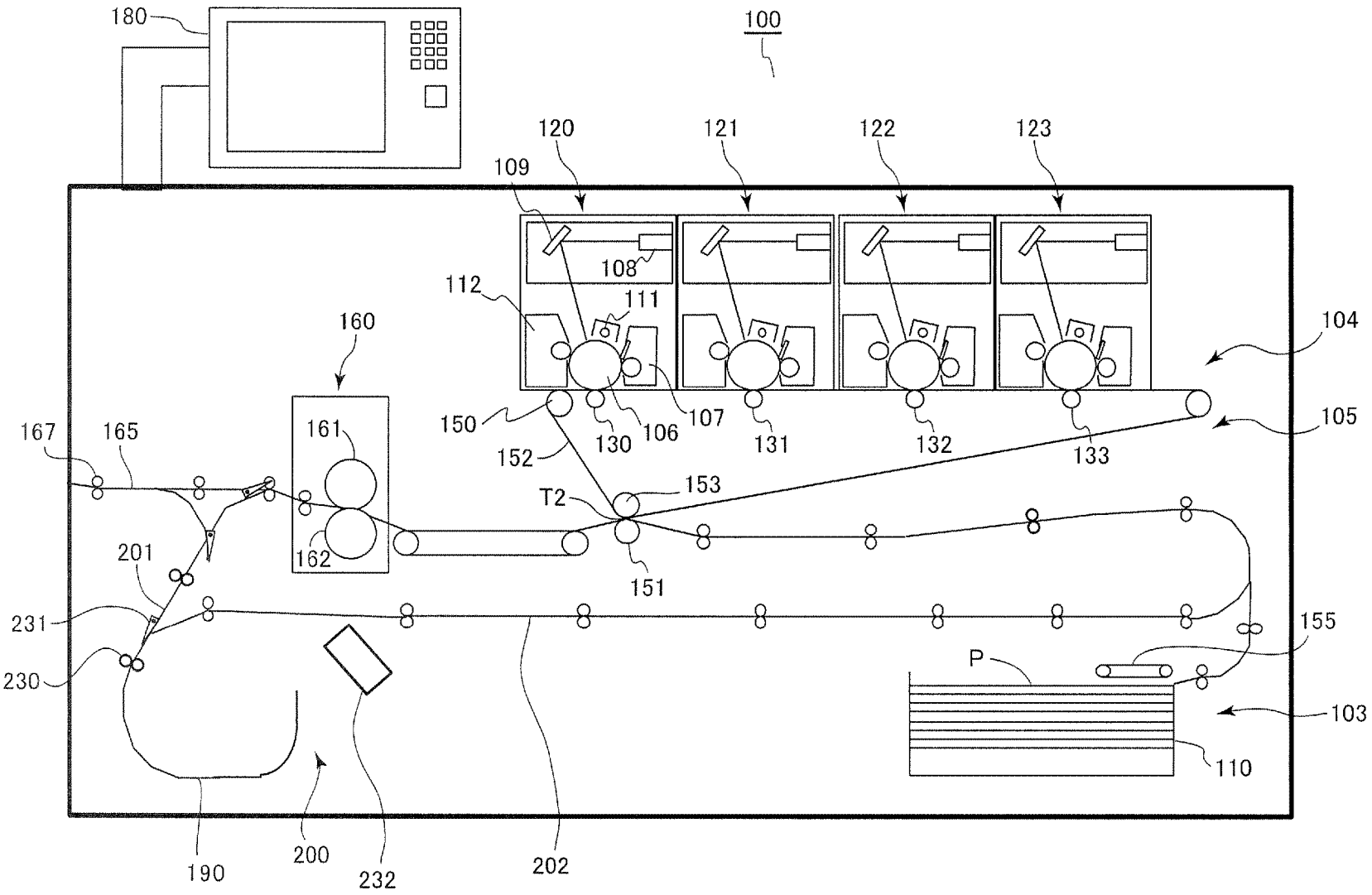
FIG. 1 is an entire schematic diagram illustrating a printer according to a first embodiment.

A first embodiment will be described. A printer 100 serving as an image forming apparatus is a full-color laser beam printer adopting an electrophotographic system. The printer 100 can use various types of sheets, such as normal paper which is used widely, recycled paper, glossy paper, coated paper, thin paper and thick paper. The printer 100 includes, as illustrated in FIG. 1, a sheet feed unit 103, an image forming unit 104, a fixing unit 160, a sheet discharge roller pair 167 and an operation unit 180. The operation unit 180 includes multiple physical keys and a liquid crystal panel, through which settings such as grammage and size of the sheet P being used can be entered.

The image forming unit 104 includes four process units 120, 121, 122 and 123 for forming toner images of four colors, which are yellow (Y), magenta (M), cyan (C) and black (Bk), and an intermediate transfer unit 105. The four process units 120, 121, 122 and 123 have the same configuration, except for the difference in the color of the images being formed. Therefore, the configuration and image forming process of only the process unit 120 will be described, and descriptions of process units 121, 122 and 123 will be omitted.

The process unit 120 includes a photosensitive member 106 that bears a toner image, a charging unit 111, a developing unit 112, a cleaning unit 107, a semiconductor laser 108 and a polygon mirror 109. The intermediate transfer unit 105 includes an intermediate transfer belt 152, and primary transfer rollers 130, 131, 132 and 133 arranged within an inner space surrounded by the intermediate transfer belt 152, the primary transfer rollers 130, 131, 132 and 133 arranged to oppose respective photosensitive members of the process units 120, 121, 122 and 123. The intermediate transfer belt 152 is rotated by a drive roller 150. The intermediate transfer unit 105 includes a secondary transfer roller 151 and a counter roller 153, and the secondary transfer roller 151 and the counter roller 153 together form a secondary transfer portion T2 serving as a transfer portion.

The fixing unit 160 serving as a fixing portion includes a heating roller 161 and a pressing roller 162 that apply predetermined heat and pressure to the sheet. The sheet feed unit 103 includes a cassette 110 storing sheets P, and a conveyance belt 155 that conveys the sheet P stored in the cassette 110.

Next, an image forming operation of the printer 100 configured as above will be described. When an image signal is entered to the semiconductor laser 108 from a personal computer and the like not shown, a laser beam corresponding to the image signal is irradiated on the photosensitive member 106 of the process unit 120 from the semiconductor laser 108.

In this state, the surface of the photosensitive member 106 is charged uniformly to predetermined polarity and potential by the charging unit 111, and by irradiating laser beams from the semiconductor laser 108 via a polygon mirror 109, an electrostatic latent image is formed on the surface thereof. The electrostatic latent image formed on the photosensitive member 106 is developed by the developing unit 112, and a yellow (Y) toner image is formed on the photosensitive member 106. Similarly, laser beams are irradiated from the semiconductor laser to respective photosensitive members of process units 121, 122 and 123, and toner images of magenta (M), cyan (C) and black (Bk) are formed on the respective photosensitive members.

These toner images are sequentially transferred to the intermediate transfer belt 152 in multilayers by having transfer bias voltage of positive polarity applied to the primary transfer rollers 130, 131, 132 and 133, and a full color toner image is formed on the intermediate transfer belt 152.

In parallel with the image forming process, the sheet P stored in the cassette 110 is fed by the conveyance belt 155 of the sheet feed unit 103. The sheet P is conveyed via a plurality of conveyance roller pairs toward the secondary transfer portion T2. The toner image borne on the intermediate transfer belt 152 is secondarily transferred to the sheet P at the secondary transfer portion T2 by having a transfer bias voltage of positive polarity applied to the secondary transfer roller 151. Thereby, a full color toner image is formed on the surface of the sheet P.

The sheet P to which the toner image has been transferred is subjected to predetermined heat and pressure by the fixing unit 160, by which the toner image is fixed to the sheet P. The sheet P to which the toner image has been fixed passes through a sheet discharge conveyance path 165 and is discharged to the exterior of the device by the sheet discharge roller pair 167.

In an operation to form images on both sides of the sheet P, the sheet P passes the fixing unit 160 before being guided to a reverse conveyance path 201. Then, the sheet P is reversed at a reverse unit 200 and guided again to the secondary transfer portion T2 through a duplex conveyance path 202. A toner image is formed on a back side of the sheet P at the secondary transfer portion T2, and the sheet P is discharged to the exterior of the device by the sheet discharge roller pair 167. The sheet P being discharged to the exterior of the device by the sheet discharge roller pair 167 can be received by a sheet processing apparatus not shown connected to the printer 100 or can be stacked on a sheet discharge tray not shown provided on the printer 100.

Reverse Unit

Figure 2:
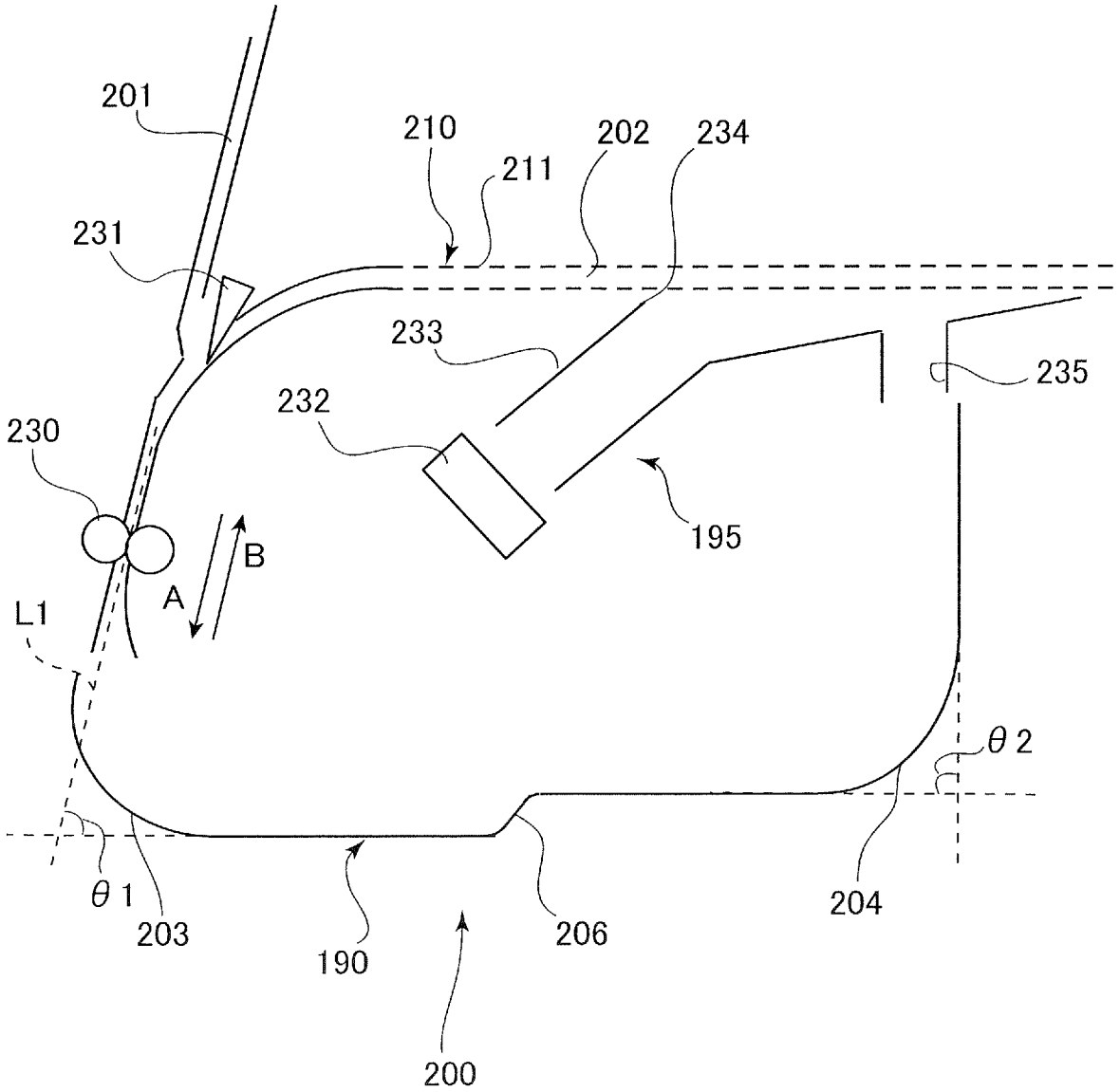
FIG. 2 is a schematic diagram illustrating a reverse unit.

Next, the reverse unit 200 will be described in detail. As illustrated in FIG. 2, the reverse unit 200 includes the reverse conveyance path 201, a guide member 231, a reverse roller pair 230, a reverse guide 190, and an air blow unit 195. The guide member 231 is disposed at a branching portion between the reverse conveyance path 201 and the duplex conveyance path 202, and it pivots to switch conveyance destinations of the sheet P being reverse-conveyed by the reverse roller pair 230.

The reverse roller pair 230 serving as a reverse conveyance portion is configured to be able to rotate in normal and reverse directions and to perform a reverse conveyance operation in which the sheet P is conveyed to a first direction A and thereafter conveyed to a second direction B that is opposite to the first direction A.

The reverse guide 190 is arranged downstream of the reverse roller pair 230 in the first direction A, and the reverse guide 190 is capable of guiding the sheet P in the reverse conveyance operation. In this state, the reverse guide 190 slidably contacts with a side of the sheet P on which the toner image has been transferred at the secondary transfer portion T2, the side hereinafter referred to as a transfer side.

Figure 3A:
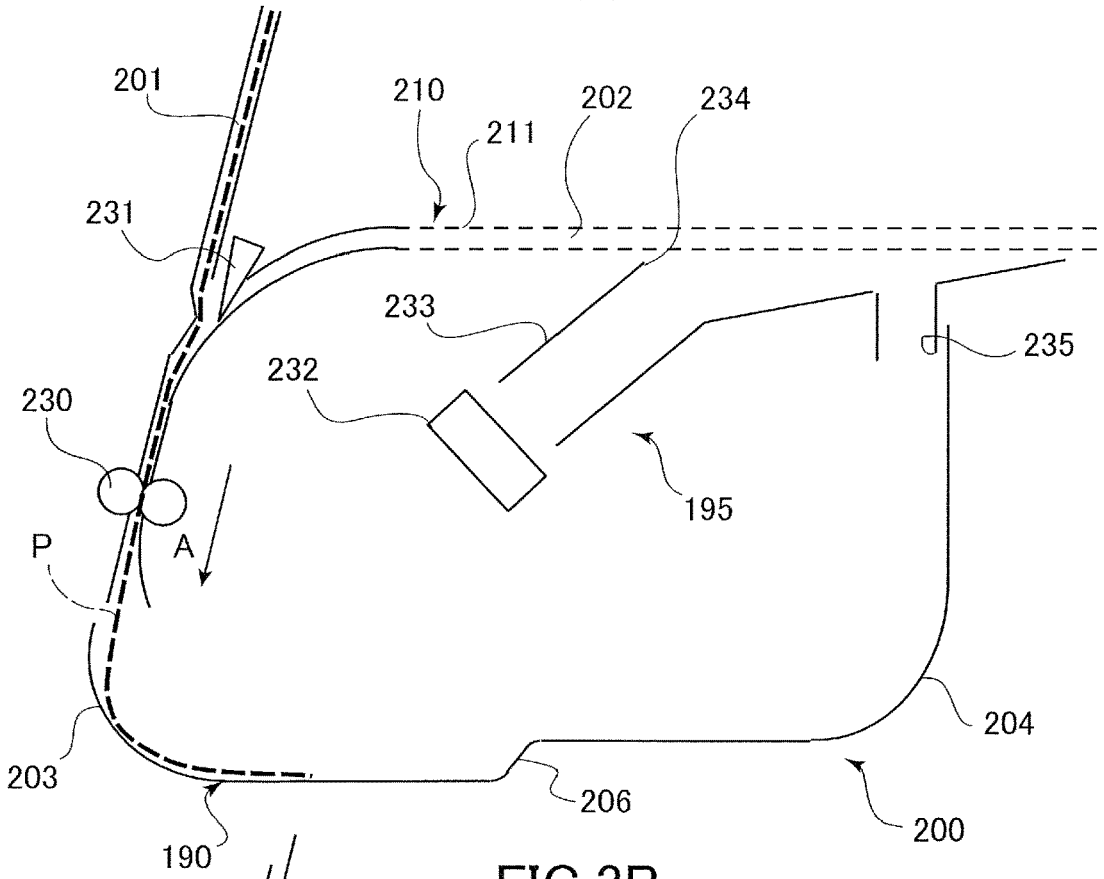
FIG. 3A is a view illustrating a sheet conveyed in a first direction.
Figure 3B:
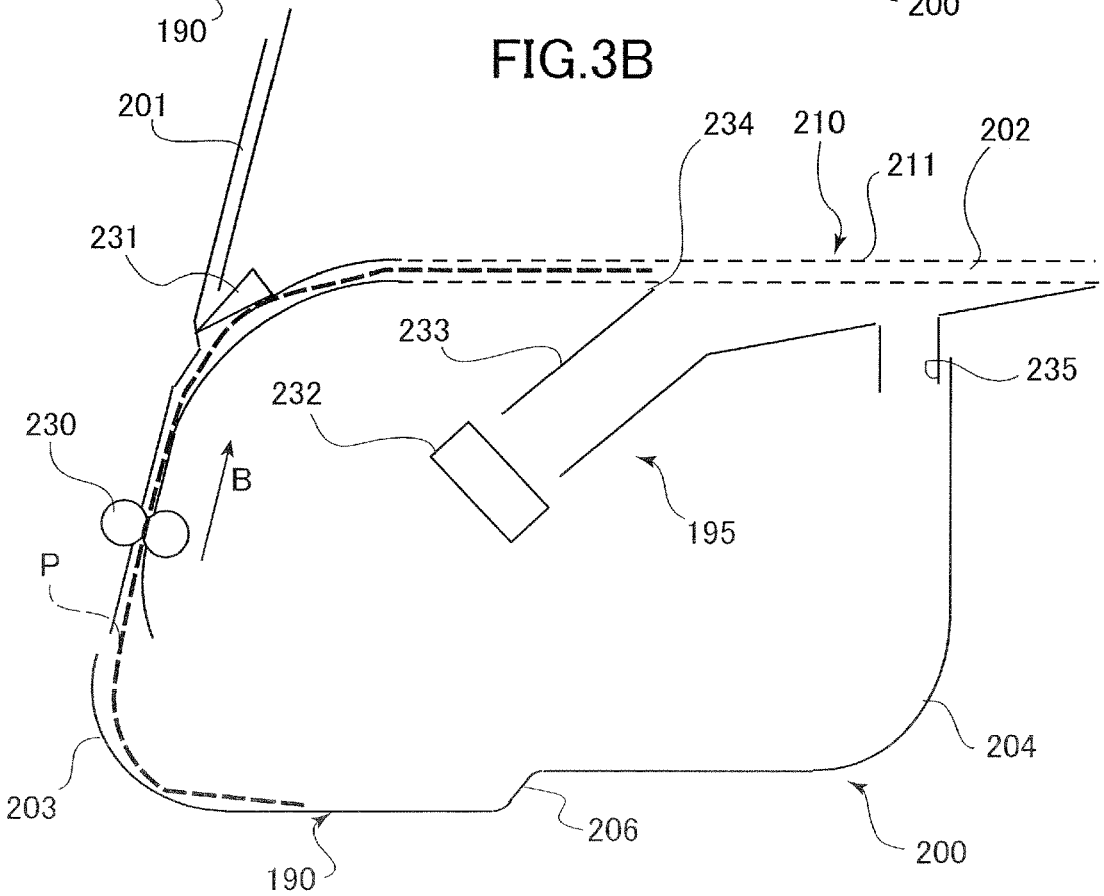
FIG. 3B is a view illustrating a sheet conveyed in a second direction.

That is, as illustrated in FIG. 3A, the sheet P conveyed in the first direction A by the reverse roller pair 230 is guided while being in slide-contact with the reverse guide 190. When a trailing edge of the sheet P passes the guide member 231, the guide member 231 pivots and the reverse roller pair 230 rotates in the reverse direction. Thereby, as illustrated in FIG. 3B, the sheet P is conveyed in the second direction B and guided by the guide member 231 to the duplex conveyance path 202. The duplex conveyance path 202 serving as a conveyance path is formed by a conveyance guide pair 210, and the conveyance guide pair 210 guides the sheet P conveyed on the conveyance path 202 toward the secondary transfer portion T2. A plurality of holes 211 through which air blown from a fan 232 described later can pass through are formed on the conveyance guide pair 210.

The air blow unit 195 includes a fan 232 serving as an air blowing portion and a duct 233, as illustrated in FIG. 2 through FIG. 3B, and the fan 232 rotates to blow air to the duct 233. The air blown to the duct 233 is sent through an opening portion 234 of the duct 233 toward the duplex conveyance path 202. The opening portion 234 is arranged at a distance of 3 mm to 6 mm from the duplex conveyance path 202, so that only a minimum amount of air leaks through the gap between the duct 233 and the duplex conveyance path 202.

Figure 9:
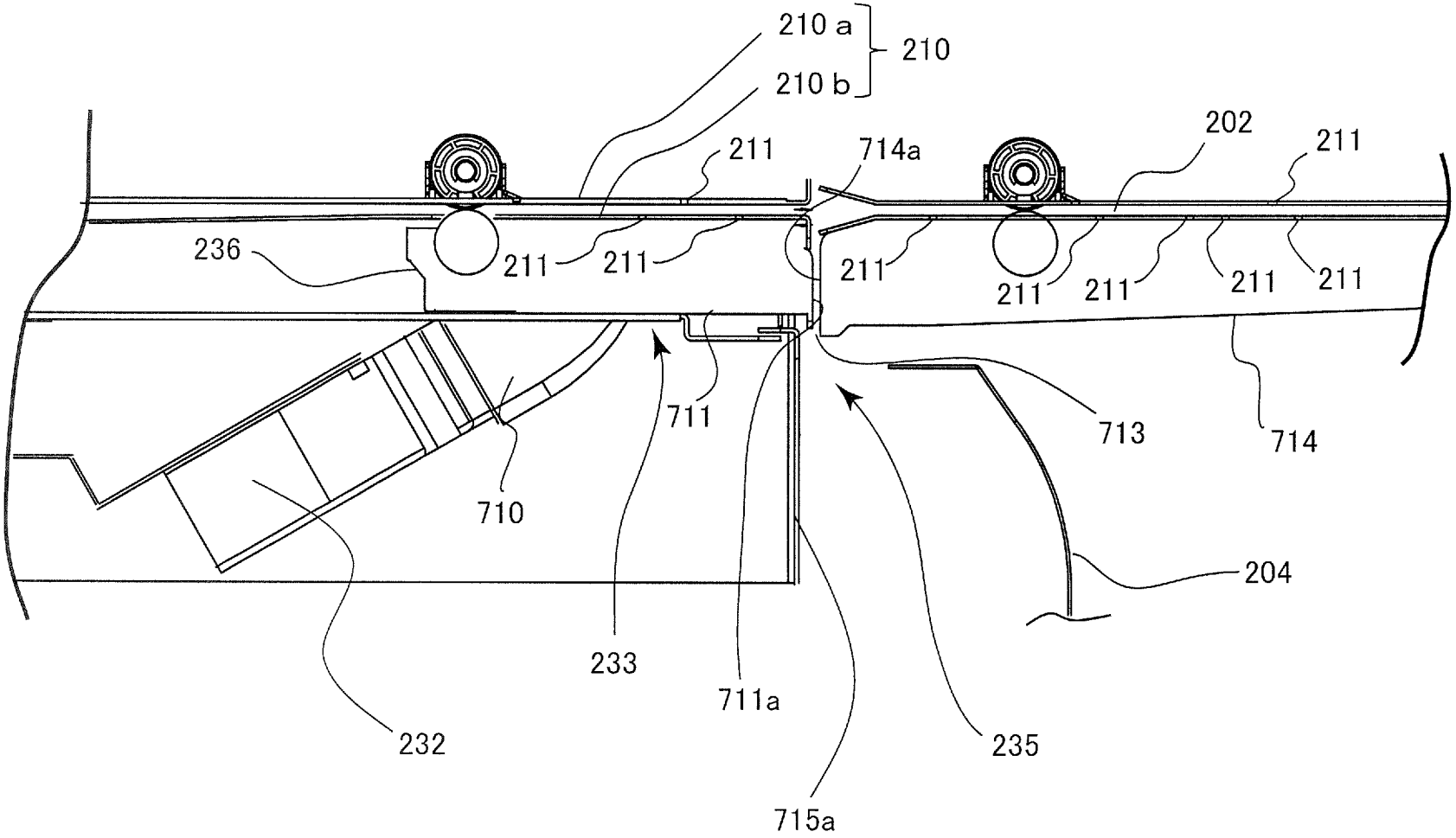
FIG. 9 is a side view illustrating a configuration of a duct.
Figure 10:
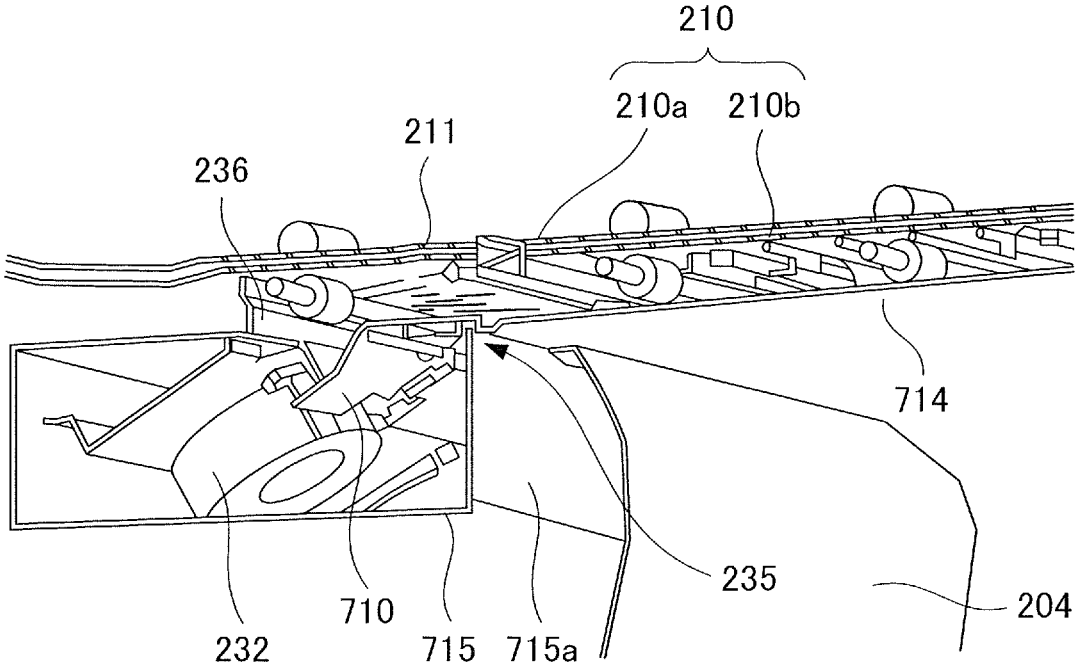
FIG. 10 is a perspective view illustrating a configuration of the duct.

FIG. 9 is a side view illustrating the configuration of the duct 233 in further detail, and FIG. 10 is a perspective view viewing obliquely from below to the duct 233, the duplex conveyance path 202 and a vicinity thereof. As illustrated in FIG. 9, the duct 233 includes a guidance member 710 that guides the air blown from the fan 232 upward, a first duct member 711 equipped with a vertical wall 236, and a second duct member 714.

The conveyance guide pair 210 constituting the duplex conveyance path 202 includes an upper guide 210*a* and a lower guide 210*b*. The first duct member 711 is arranged on an opposite side from the upper guide 210*a* with the lower guide 210*b* interposed therebetween. A flow path through which air flows is formed by the first duct member 711 and the lower side of the lower guide 210*b*. The second duct member 714 is arranged on an opposite side from the upper guide 210*a* with the lower guide 210*b* interposed therebetween. A flow path through which air flows is formed by the second duct member 714 and the lower side of the lower guide 210*b*.

The air inside the duct 233 flows to a conveyance direction of the sheet in the duplex conveyance path 202. A gap 713 is formed between the first duct member 711 and the second duct member 714. In further detail, the gap 713 is formed of a connecting surface 711*a* of the first duct member 711 and a connecting surface 714*a* of the second duct member 714 opposed to the connecting surface 711*a*. The air in the duct 233 flows to the exterior of the duct 233 through the gap 713 serving as an opening of the duct 233. The air having passed through the gap 713 passes between an end portion of a reverse guide 190 and a side plate 715*a* of a stay 715 that supports the fan 232 and flows downward, that is, toward a guide surface of the reverse guide 190. A ventilation portion 235 through which the air blown from the fan 232 toward the reverse guide 190 passes is formed by the gap 713 and the space between the reverse guide 190 and the side plate 715*a* of the stay 715.

Since a plurality of holes 211 are formed on the conveyance guide pair 210, as illustrated in FIG. 2, the air generated by the fan 232 passes through the plurality of holes 211 on the duplex conveyance path 202 and the conveyance guide pair 210 and is sent to the interior of the printer 100. Generally, water vapor is released from the sheet heated by the fixing unit 160 by evaporation of moisture contained in the sheet. The water vapor is cooled at the conveyance guide pair 210 and dew condensation may occur at the conveyance guide pair 210. By having dew condensation as water drops attach to the sheet P, image defects or jamming of sheets caused by the sheet P being adhered on the conveyance guide pair 210 may occur.

However, according to the present embodiment, the air generated by the fan 232 passes through the plurality of holes 211 formed on the duplex conveyance path 202 and the conveyance guide pair 210 and is sent into the printer 100. Therefore, water vapor released from the sheet P is prevented from accumulating in the duplex conveyance path 202, and generation of dew condensation in the conveyance guide pair 210 can be reduced. Thereby, image defects and jamming of sheets can be reduced.

Further, at least a portion of the air blown from the fan 232 through the duct 233 passes the ventilation portion 235 toward the reverse guide 190. The fan 232 is arranged on a same side as the ventilation portion 235 with respect to the duplex conveyance path 202 within a space surrounded by the reverse guide 190 and the conveyance guide pair 210. Thereby, the reverse unit 200 can be downsized.

The ventilation portion 235 and a downstream end of the reverse guide 190 in the first direction A are arranged close to one another. The reverse guide 190 includes a first curved portion 203 that is curved at a position downstream of the reverse roller pair 230 in the first direction A, and a second curved portion 204 that is curved at a position downstream of the first curved portion 203 in the first direction A toward the ventilation portion 235.

More specifically, the first curved portion 203 is arranged to cross a nip line L1 of the reverse roller pair 230, and the second curved portion 204 is arranged at a front of the ventilation portion 235 in an opening direction. The reverse guide 190 is extended toward an approximately horizontal direction at a position downstream of the first curved portion 203 in the first direction A, and an angle θ1 formed by the nip line L1 and a horizontal plane is approximately 40 to 80 degrees. An angle θ2 formed by an upstream side of the second curved portion 204 in the first direction A and an extended line of the surface of the reverse guide 190 on the downstream side is set to approximately 80 to 90 degrees. As described, the second curved portion 204 is curved more gently than the first curved portion 203, and a radius of curvature thereof is 70 mm or greater. The sheet P passed through the second curved portion 204 of the reverse guide 190 is conveyed upward in an approximately vertical direction.

A stepped portion 206 is formed on the reverse guide 190 between the first curved portion 203 and the second curved portion 204. The sheet P is guided approximately in the horizontal direction at both the upstream and downstream sides of the stepped portion 206 in the first direction A, but the upstream side of the stepped portion 206 in the first direction A is positioned lower than the downstream side thereof. An angle of an inclined surface of the stepped portion 206 is set to approximately 10 to 30 degrees. Since the stepped portion 206 is formed on the reverse guide 190, a leading end of the sheet P is raised from the reverse guide 190 while the sheet P passes the stepped portion 206.

Further, there is no guide member provided between the reverse guide 190 and the fan 232. If a guide member is provided on an upper portion of the reverse guide 190, the sheet P may be rubbed against the guide member while the sheet P is conveyed by the reverse roller pair 230 in a second direction B, and may cause increase of conveyance resistance of the sheet P or cause scuff marks to be left on the sheet P.

Conveyance Operation of Sheet and Air Flow

Figure 4A:
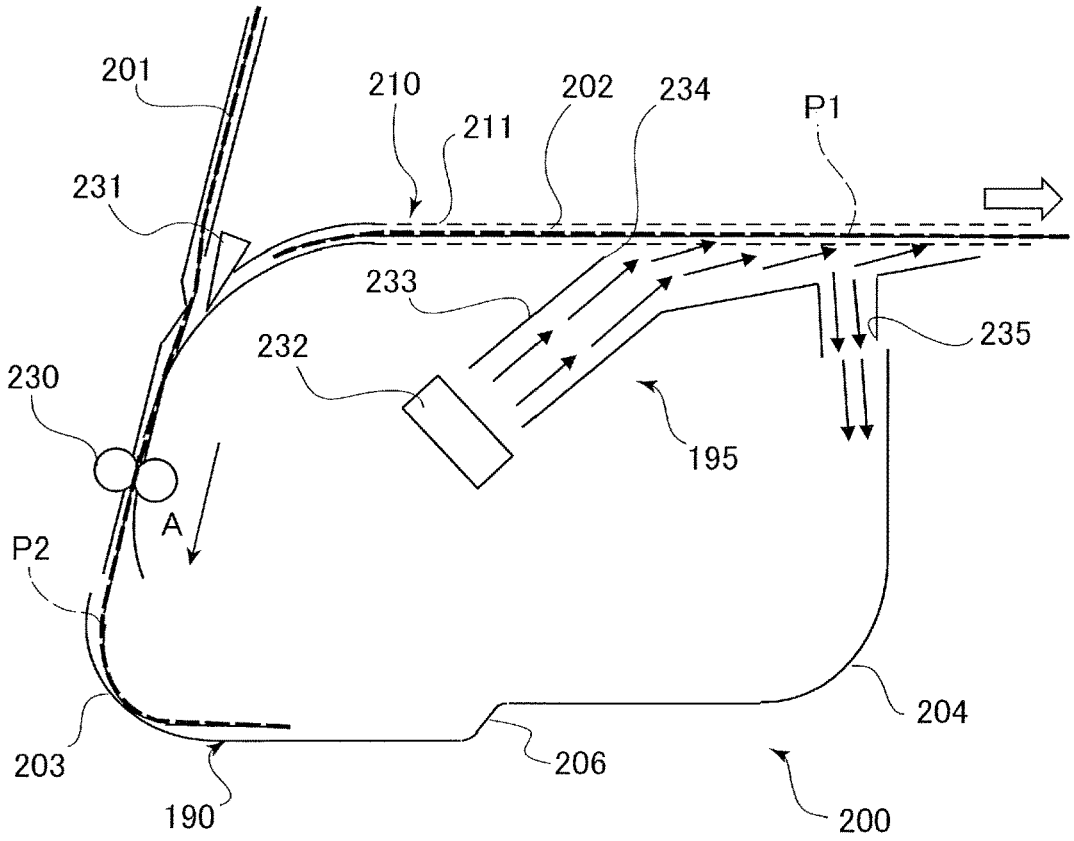
FIG. 4A is a view illustrating a state where air blown from a fan is blocked by a preceding sheet.
Figure 4B:
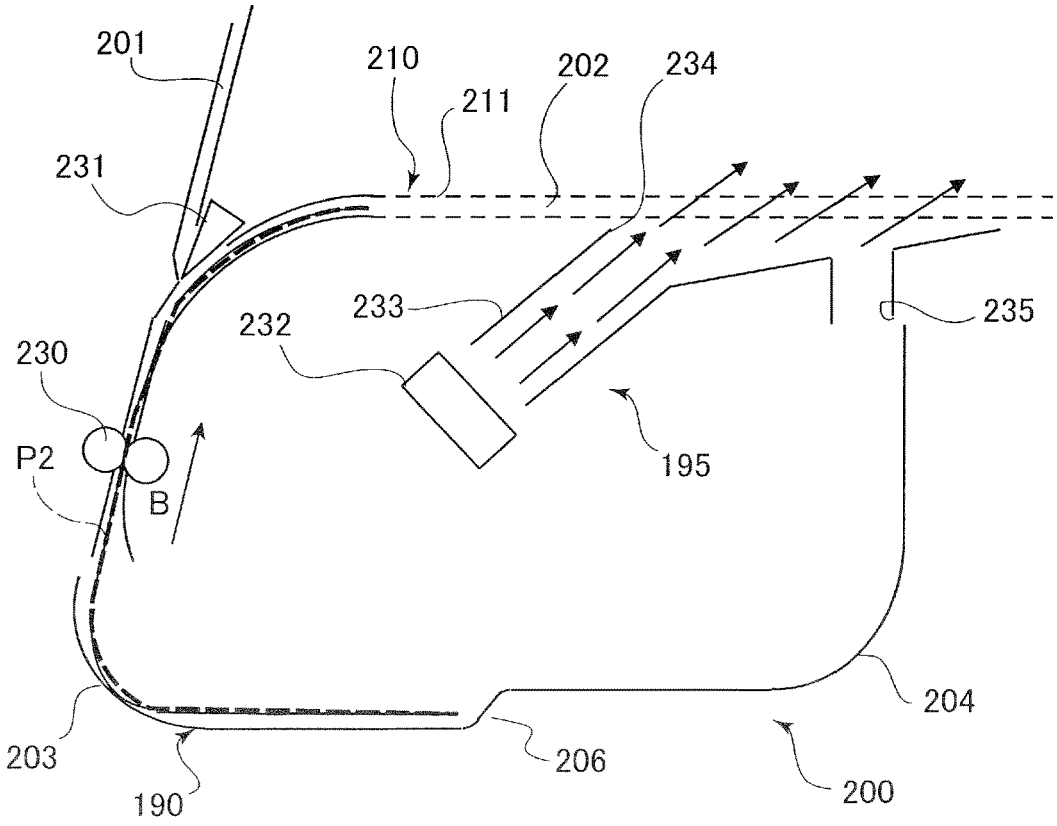
FIG. 4B is a view illustrating a state where air blown from the fan is not blocked by the sheet.

Next, a relationship between conveyance operation of the sheet P and air flow will be described. FIGS. 4A and 4B are explanatory views illustrating the flow of sheets and the flow of air, and in FIGS. 4A and 4B, sheet P1 represents a preceding sheet, and sheet P2 represents a succeeding sheet that follows the preceding sheet.

As illustrated in FIG. 4A, while the sheet P2 is conveyed in the first direction A by the reverse roller pair 230, the sheet P1 is positioned above the ventilation portion 235, that is, at a position receiving air flow from the duct 233. In this state, the air blown from the fan 232 toward the duplex conveyance path 202 blows against the sheet P1 passing the duplex conveyance path 202 and is blocked thereby. Then, the space through which the air can flow is limited by the wall surface of the duct 233 and the sheet P1, and internal pressure of the duct 233 is increased.

Therefore, the air that has limited space to escape within the duct 233 is flown through the ventilation portion 235 toward the reverse guide 190. The air blown to the reverse guide 190 is changed directions by the second curved portion 204 that curves relatively gently, and flows along the reverse guide 190 from the downstream side toward the upstream side in the first direction A. The air blown along the reverse guide 190 flows between the sheet P2 and the reverse guide 190, either lifting the sheet P2 with respect to the reverse guide 190 or reducing frictional resistance between the sheet P2 and the reverse guide 190.

Figure 5:
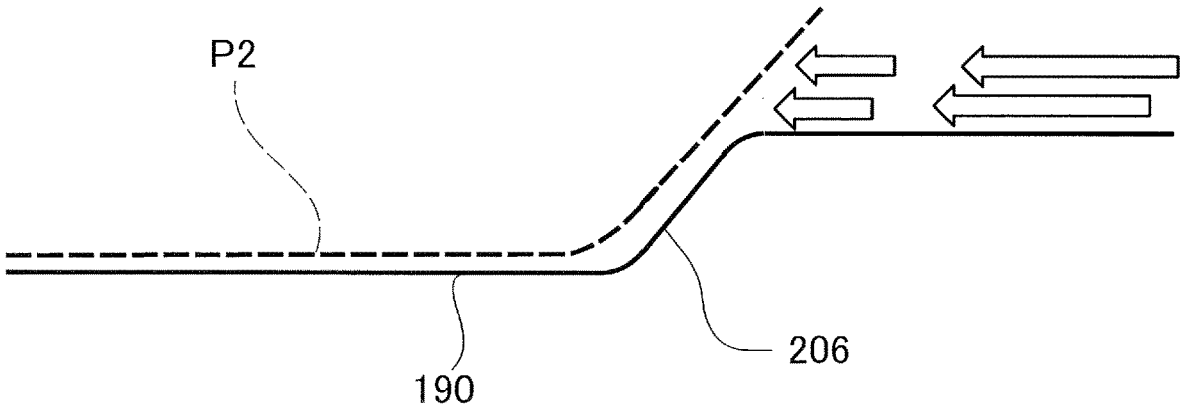
FIG. 5 is a schematic diagram illustrating a stepped portion formed on the reverse guide.

Especially, as illustrated in FIG. 5, the stepped portion 206 is formed on the reverse guide 190, so that a leading edge of the sheet P2 is lifted by the stepped portion 206, allowing air to flow between the sheet P2 and the reverse guide 190. Thereby, adhesion of the sheet P2 to the reverse guide 190 is reduced, and conveyance failure such as jamming of sheets can be reduced.

In the reverse unit 200 as according to the present embodiment, the sheet P is conveyed in a state where the transfer side is arranged downward in the vertical direction. In a state where the applied amount of toner on the transfer surface is great or the temperature of the sheet is high, the sheet P tends to adhere to the reverse guide 190. This is because the toner that has just passed through the fixing unit 160 is heated and softened, and the frictional force between the reverse guide 190 and the toner becomes high. Further, when the sheet P is conveyed by the reverse roller pair 230 to the first direction A, the distance between the leading edge of the sheet P and the reverse roller pair 230 becomes long, and the leading edge of the sheet P may hang down by its own weight, causing increase of frictional force between the sheet P and the reverse guide 190, and causing buckling to occur easily.

However, according to the present embodiment, air is blown between the sheet P2 and the reverse guide 190 while the sheet P2 is conveyed in the first direction A, so that adhesion of the sheet P2 to the reverse guide 190 can be suppressed effectively. Further, since the transfer surface of the sheet P1 is also cooled by the air from the fan 232, adhesion of the sheet P1 to the conveyance guide pair 210 can be suppressed. Thereby, the likeliness of the sheet P buckling and causing conveyance failure can be reduced.

Further, as illustrated in FIG. 4B, in a state where the sheet P1 passes the area in which the duct 233 is arranged and the sheet P2 is started to be conveyed in the second direction B by the reverse roller pair 230, the air blown from the fan 232 to the duplex conveyance path 202 is not blocked by the sheet. Therefore, water vapor will not be retained in the duplex conveyance path 202, and the generation of dew condensation in the conveyance guide pair 210 can be reduced.

As described, according to the present embodiment, in a state where the succeeding sheet P2 enters the reverse guide 190, the air from the fan 232 is blown against the sheet P1 and air is flown between the sheet P2 and the reverse guide 190. Further, while the sheet P2 is conveyed in the second direction B, the sheet P1 will not block the air from the fan 232, and air flows through the plurality of holes 211 formed on the conveyance guide pair 210. Thereby, conveyance failure caused by the sheet adhering to the reverse guide 190 can be reduced, and image failure caused by dew condensation can be reduced.

A configuration where holes 211 are formed on both the upper guide 210*a* and the lower guide 210*b* has been described, but a configuration can also be adopted where the holes 211 are formed only on the lower guide 210*b* and not on the upper guide 210*a*. Further, a configuration has been described where the opening on the duct 233 through which air flowing toward the reverse guide 190 passes is composed of the gap 713 between the first duct member 711 and the second duct member 712, but for example, holes can also be formed on the first duct member 711.

Second Embodiment

Next, a second embodiment of the present invention will be described. The second embodiment has a fan arrangement and circumferential configuration that differ from the first embodiment. Therefore, the configurations similar to the first embodiment are either not shown or denoted with the same reference numbers in the drawing.

Figure 6:
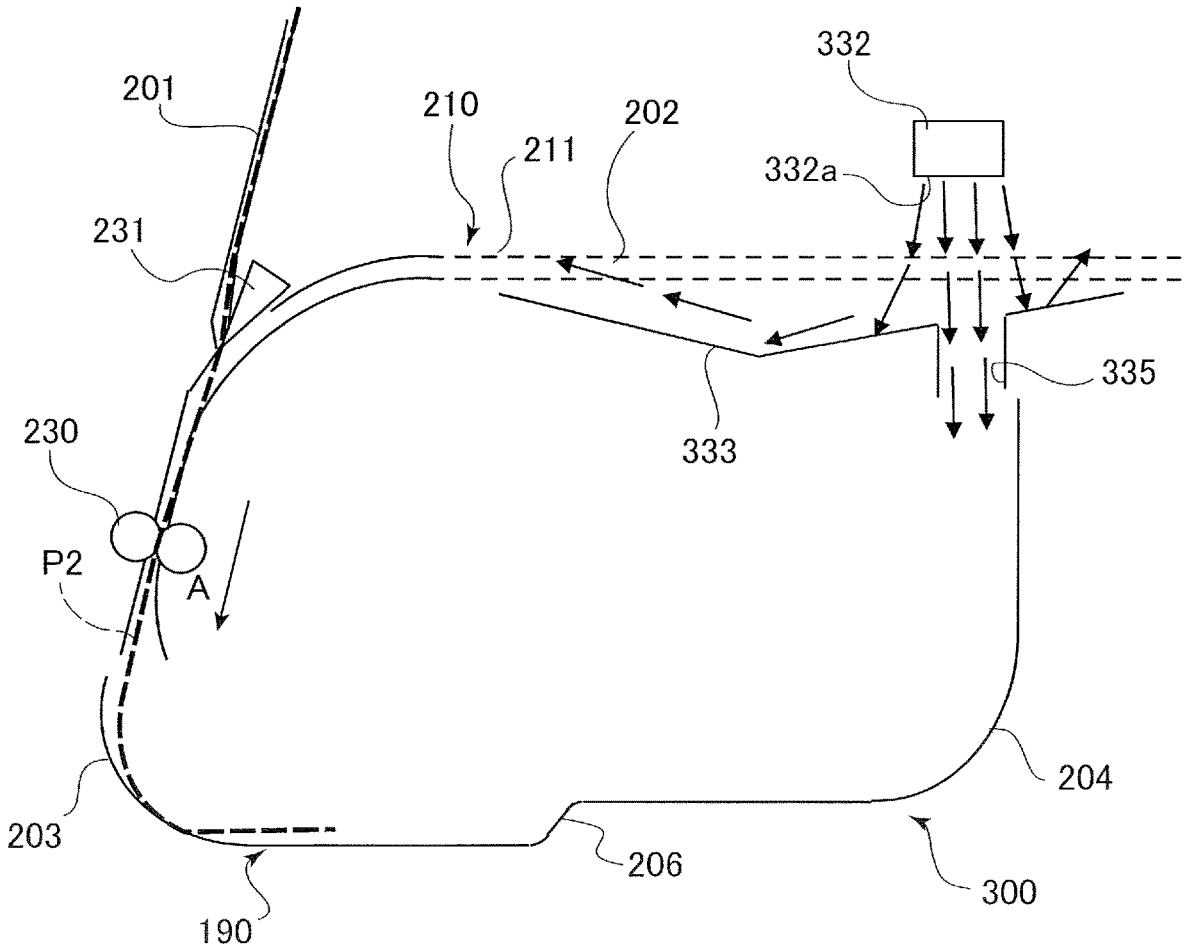
FIG. 6 is a view illustrating a reverse unit according to a second embodiment.

A reverse unit 300 according to the second embodiment includes, as illustrated in FIG. 6, the reverse guide 190, the conveyance guide pair 210 constituting the duplex conveyance path 202, a fan 332 and a duct 333. A ventilation portion 335 that guides at least a portion of the air blown from the fan 332 toward the reverse guide 190 is formed on the duct 333. The fan 332 is arranged at a position opposed to the ventilation portion 335 with the duplex conveyance path 202 interposed therebetween, and it sends a large amount of air to the ventilation portion 335 with the conveyance guide pair 210 interposed therebetween. That is, an opening 332*a* of the fan 332 is opposed to the ventilation portion 335, and air blown from the fan 332 directly flows into the ventilation portion 335 without being guided by other members.

According to the present embodiment, a distance between a preceding sheet P1 (refer to FIG. 4A) and a succeeding sheet P2, hereinafter referred to as sheet interval, is longer than the first embodiment. Therefore, as illustrated in FIG. 6, in a state where the sheet P2 is drawn toward the first direction A by the reverse roller pair 230, the sheet P1 has already passed the ventilation portion 335. Therefore, air blown from the fan 332 toward the duplex conveyance path 202 is flown into the ventilation portion 335 without being blocked by the sheet P1, so that air can be sent efficiently to the reverse guide 190. Therefore, adhesion of the sheet P to the reverse guide 190 can be reduced further, and conveyance failure can be reduced.

Figure 7:
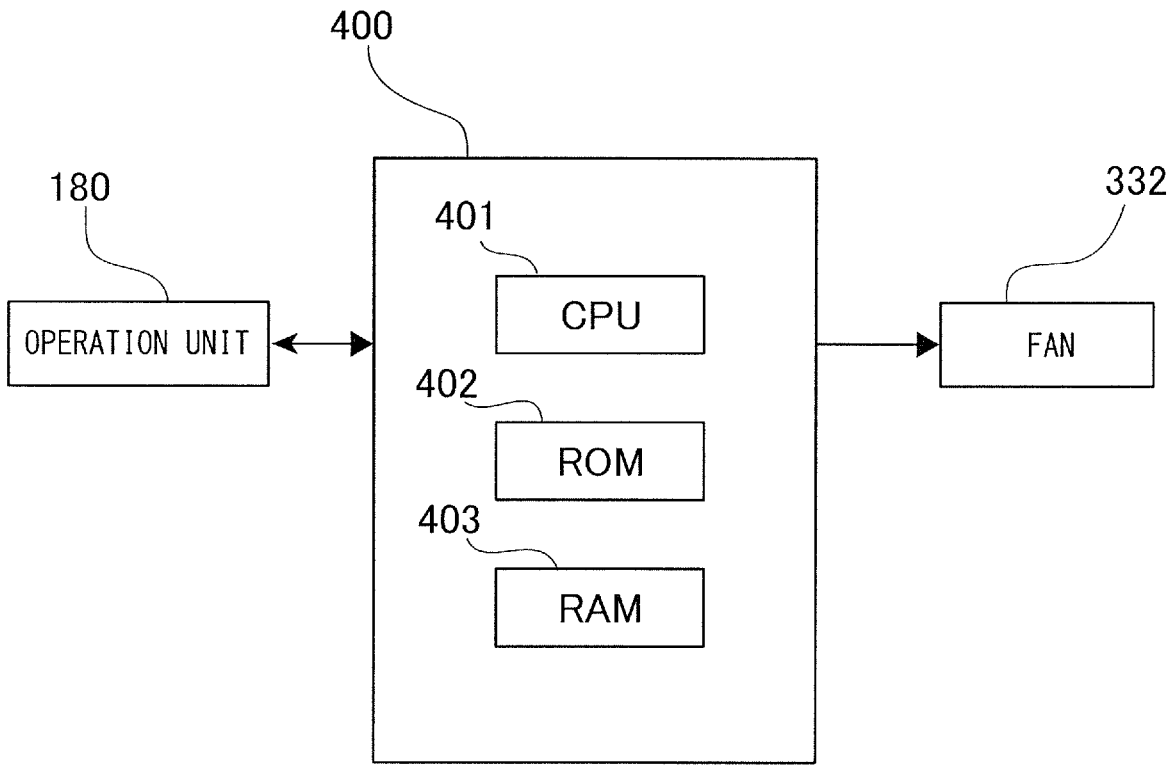
FIG. 7 is a control block diagram according to a second embodiment.

Further according to the present embodiment, the air volume of the fan 332 can be changed according to the grammage of the sheet being conveyed. For example, as illustrated in FIG. 7, a control unit 400 according to the present embodiment includes a CPU 401, a ROM 402 that stores programs, and a RAM 403 that is used as a program execution area. The operation unit 180 and the fan 332 are connected to the control unit 400.

Figure 8:
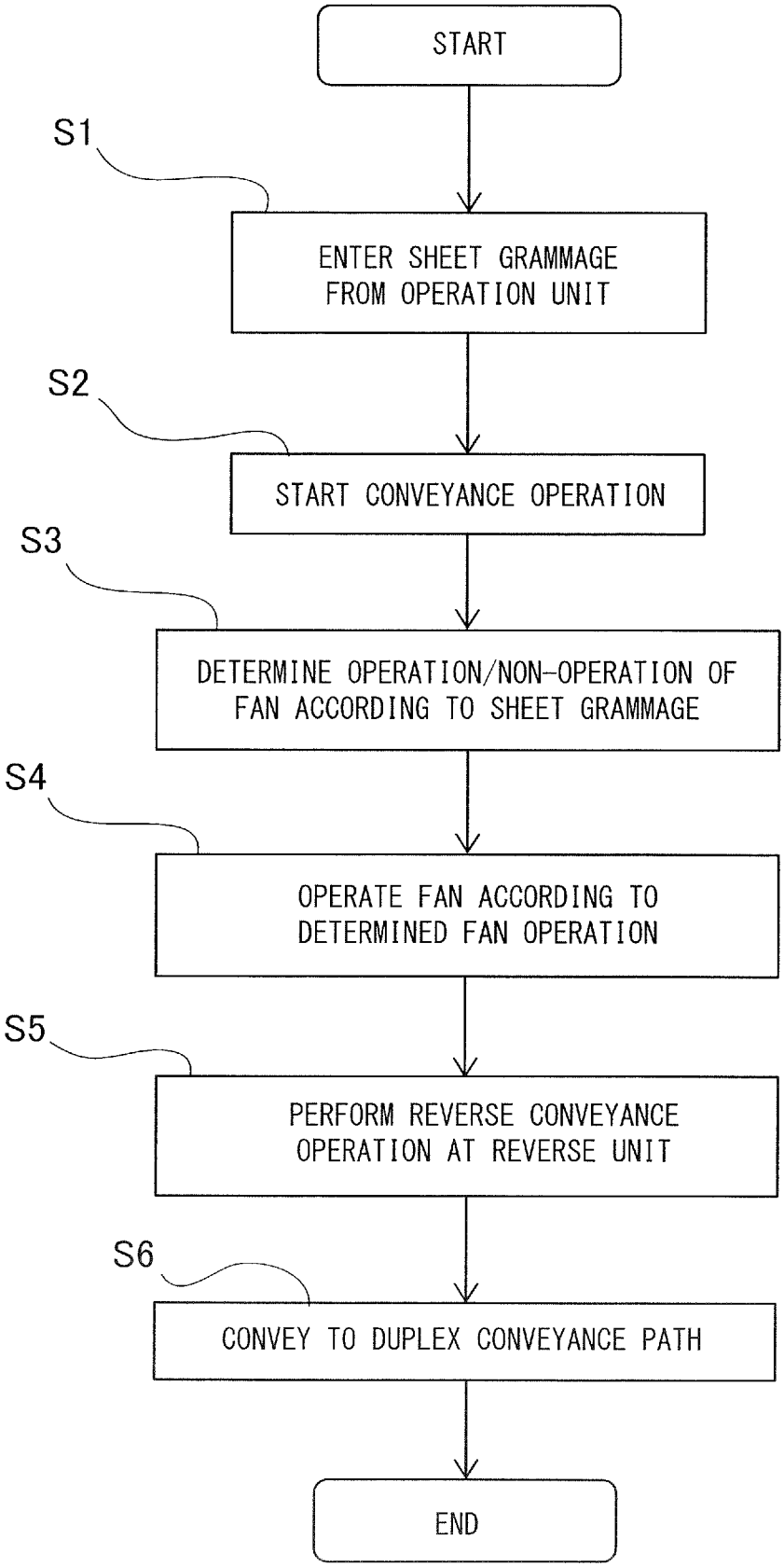
FIG. 8 is a flowchart illustrating a processing performed by a control unit.

The control processing performed by the control unit 400 will be described with reference to the flowchart of FIG. 8. At first, the user enters the grammage of the sheet P through the operation unit 180 (step S1). The entered grammage is stored for example in the RAM 403. Thereafter, conveyance operation of the sheet having the entered grammage is started (step S2). In this state, the control unit 400 determines whether or not to activate the fan 332 based on the grammage of the sheet P (step S3).

For example, the fan 332 is activated if the entered grammage is equal to or greater than a certain grammage, and the fan 332 is not activated if the grammage is smaller than the certain grammage. This is to prevent the problem of the sheet having a small grammage being folded during conveyance by the influence of air if the air volume of air blown toward the reverse guide 190 is great, as according to the present embodiment. Since a sheet having small grammage receives only small amount of heat from the fixing unit 160, the sheet has smaller risk of being adhered to the reverse guide 190 than the sheets having greater grammage. In addition to switching whether or not to activate the fan 332, any method can be adopted as long as the air volume being blown from the fan 332 is changed, such as by changing the rotation speed of the fan 332.

The control unit 400 activates the fan 332 according to the determined operation of the fan 332, and in this state, the sheet P is subjected to reverse conveyance by the reverse roller pair 230 (steps S4 and S5). Thereafter, the sheet P is conveyed to the duplex conveyance path 202 by the guide member 231 (step S6). As described, various types of sheets can be conveyed suitably by changing the air volume of the fan 332 according to the grammage of the sheet. In addition to the grammage of the sheet, the air volume of the fan 332 can also be changed according to the sheet type, such as whether the sheet is normal paper, coated paper or an envelope. Further, the control of the fan 332 according to the grammage of the sheet can also be applied to the first embodiment.

In the first embodiment, conveyance control was performed so that the air from the fan 232 blows against the preceding sheet P1 in a state where the succeeding sheet P2 is conveyed in the first direction A, but the present invention is not restricted thereto. For example, the air from the fan 232 can blow against the sheet P1 in a state where the sheet P2 is conveyed in the second direction B.

According to any of the embodiments described earlier, it is possible to independently provide a fan for reducing dew condensation in the duplex conveyance path 202 and a fan for reducing adhesion of the sheet guided by the reverse guide 190. Further, it is possible to provide one fan and divide the air blown from the fan into multiple flows through a plurality of ducts.

According to any of the above-described embodiments, the stepped portion 206 has an inclined surface that is inclined upward toward a downstream side in the first direction A, but the present invention is not restricted thereto. For example, the stepped portion 206 can be equipped with an inclined surface that is inclined downward toward the downstream side in the first direction A.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-163333, filed on Aug. 31, 2018, and Japanese Patent Application No. 2019-129410, filed on Jul. 11, 2019, which are hereby incorporated by reference herein in their entirety.

What is claimed is:

1. An image forming apparatus comprising:

a transfer portion configured to transfer a toner image to a sheet;

a fixing portion configured to fix the toner image transferred by the transfer portion to the sheet;

a reverse conveyance portion configured to perform a reverse conveyance operation in which the sheet onto which the toner image has been fixed is conveyed in a first direction and thereafter conveyed in a second direction that is opposite to the first direction;

a reverse guide configured to guide the sheet in the reverse conveyance operation;

a conveyance guide pair configured to form a conveyance path through which the sheet subjected to the reverse conveyance operation passes, and to guide the sheet toward the transfer portion;

an air blowing portion configured to blow air toward the conveyance path; and a ventilation portion through which air blowing toward the reverse guide passes, wherein in a state where a succeeding sheet conveyed by the reverse conveyance portion in the first direction is guided by the reverse guide, air blown from the air blowing portion blows against a preceding sheet passing through the conveyance path, passes through the ventilation portion, and flows along the reverse guide.

2. The image forming apparatus according to claim 1, wherein the air having passed through the ventilation portion flows along the reverse guide from a downstream side toward an upstream side in the first direction.

3. The image forming apparatus according to claim 1, wherein the air blowing portion is arranged on a same side as the ventilation portion with respect to the conveyance path.

4. The image forming apparatus according to claim 1, wherein the air blowing portion is arranged between the reverse guide and the conveyance guide pair.

5. The image forming apparatus according to claim 1, wherein the air blowing portion is arranged at a position opposed to the ventilation portion interposing the conveyance path, and air blown from the air blowing portion is sent to the ventilation portion through the conveyance path.

6. The image forming apparatus according to claim 1, wherein the conveyance guide pair comprises a hole through which air blown from the air blowing portion passes.

7. The image forming apparatus according to claim 1, wherein the reverse guide comprises a first curved portion configured to curve at a position downstream of the reverse conveyance portion in the first direction, and a second curved portion configured to curve toward the ventilation portion at a position downstream of the first curved portion in the first direction.

8. The image forming apparatus according to claim 7, wherein the reverse guide comprises a stepped portion between the first curved portion and the second curved portion.

9. The image forming apparatus according to claim 1, further comprising a control unit configured to change an air volume blown from the air blowing portion according to a grammage of the sheet being conveyed.

10. The image forming apparatus according to claim 1, wherein the air blowing portion comprises a fan configured to rotate and generate air flow.

11. The image forming apparatus according to claim 1, further comprising a duct through which air blown from the air blowing portion passes.

12. The image forming apparatus according to claim 11, wherein the ventilation portion includes an opening provided on the duct.

13. The image forming apparatus according to claim 11, wherein the duct comprises a first conveyance guide of the conveyance guide pair and a duct member arranged on an opposite side from a second conveyance guide of the conveyance guide pair interposing the first conveyance guide.

14. The image forming apparatus according to claim 11, wherein the air blowing portion, the duct and the ventilation portion are arranged on a same side with respect to the conveyance path.

15. The image forming apparatus according to claim 1, wherein the reverse guide slidably contacts a side, of the sheet, to which the toner image has been transferred by the transfer portion.

16. The image forming apparatus according to claim 1, wherein the conveyance path is configured to guide the sheet, having a first surface onto which the toner image has been fixed by the fixing portion, toward the transfer portion so as to transfer a toner image to a second surface opposite to the first surface of the sheet by the transfer portion.

* * * * *